United States Patent [19]

Elsas

[11] 4,055,290

[45] Oct. 25, 1977

[54] ROPE PULLING DEVICE

[76] Inventor: Floyd O. Elsas, 458 Arroyo Road, Santa Barbara, Calif. 93110

[21] Appl. No.: 767,758

[22] Filed: Feb. 11, 1977

[51] Int. Cl.[2] ..... B65H 17/26

[52] U.S. Cl. ..... 226/128; 226/53; 226/156; 254/164

[58] Field of Search ..... 254/161-164, 254/167, 138, 191, 175.5, 150 R, 135, 53, 76, 186 HC, 175.3; 226/127, 128, 156, 53; 188/65.1, 82.3, 82.7; 74/504; 105/477

[56] References Cited

U.S. PATENT DOCUMENTS

| | | | |
|---|---|---|---|
| 757,893 | 4/1904 | Daughters | 254/51 |
| 3,756,565 | 9/1973 | Sakai | 188/65.1 X |

*Primary Examiner*—Robert J. Spar
*Assistant Examiner*—Donald W. Underwood
*Attorney, Agent, or Firm*—Jack C. Munro

[57] ABSTRACT

A rope pulling device which is compact in size which includes a housing adapted to be fixed to an exterior object. A rope is to be physically placed between a pair of cog wheels which are biased into continuous contact with the rope surface. Each of the cog wheels are operatively driven by separate driven gears with each driven gear being rotatably mounted on a plate. Each of the plates are interconnected to move together to mirror image angular positions through a cam means. Each of the plates are also pivotally mounted upon the housing. A handle means is rotationally mounted upon the housing and is operatively connected to drive a drive gear which, in turn, is operatively connected to drive each of the driven gears in the same direction of rotation at the same angular velocity. Upon operation of the handle means, the driven gears are rotated simultaneously which causes linear movement of a rope placed therebetween with respect to the housing.

8 Claims, 9 Drawing Figures

ROPE PULLING DEVICE

BACKGROUND OF THE INVENTION

The field of this invention relates to lever mechanical movement devices and more particularly to a device which is adapted to pull a rope taut with a greater degree of force that is possible with a direct manual pulling force.

Rope pulling devices have been known for a substantial period of time. Such devices are commonly used to pull ropes taut over loads which are physically mounted upon vehicles, such as trucks or in any environment in which it is required to pull a rope taut. Normally, it is not humanly physically possible to pull a rope taut enough about an object to secure the object with a desired degree of force. In order to achieve this end, rope pullers have been employed which are devices which basically gear down a person's manual force so that the rope can be pulled to a substantially greater degree of tautness than possible manually.

Previously, such rope pulling devices have been of substantial size and of substantial complexity in construction. Portability is a big factor in the use of any rope pulling device and prior rope pulling devices have been too large and too complex to facilitate portability, that is, to be readily carried by a person from one locale to another and being sufficiently compact in size to be readily carried in the person's pocket. Without this element of portability, when it is desired to use such a device, such devices in the past have been found to be not right at the "finger tips" of the user. Therefore, the device is either not used or it is required to move to the locale where the device is located and obtain such and then reposition oneself back to the original locale to effect using of the device.

SUMMARY OF THE INVENTION

The device of this invention is believed to be summarily described in the Abstract Of The Disclosure and reference is to be had thereto.

The primary objective of this invention is to design a rope pulling device which is small in size and can be readily carried upon a person from one locale to another and used in the desired manner.

A further objective of this invention is that the device is constructed of few parts easily assembled together to facilitate inexpensive manufacturing.

A further advantage of this invention is that it includes a safety mechanism to prevent unauthorized reversal of the device when a substantial torque has been applied to a rope.

DETAILED DESCRIPTION OF THE SHOWN EMBODIMENT

Figure 1:
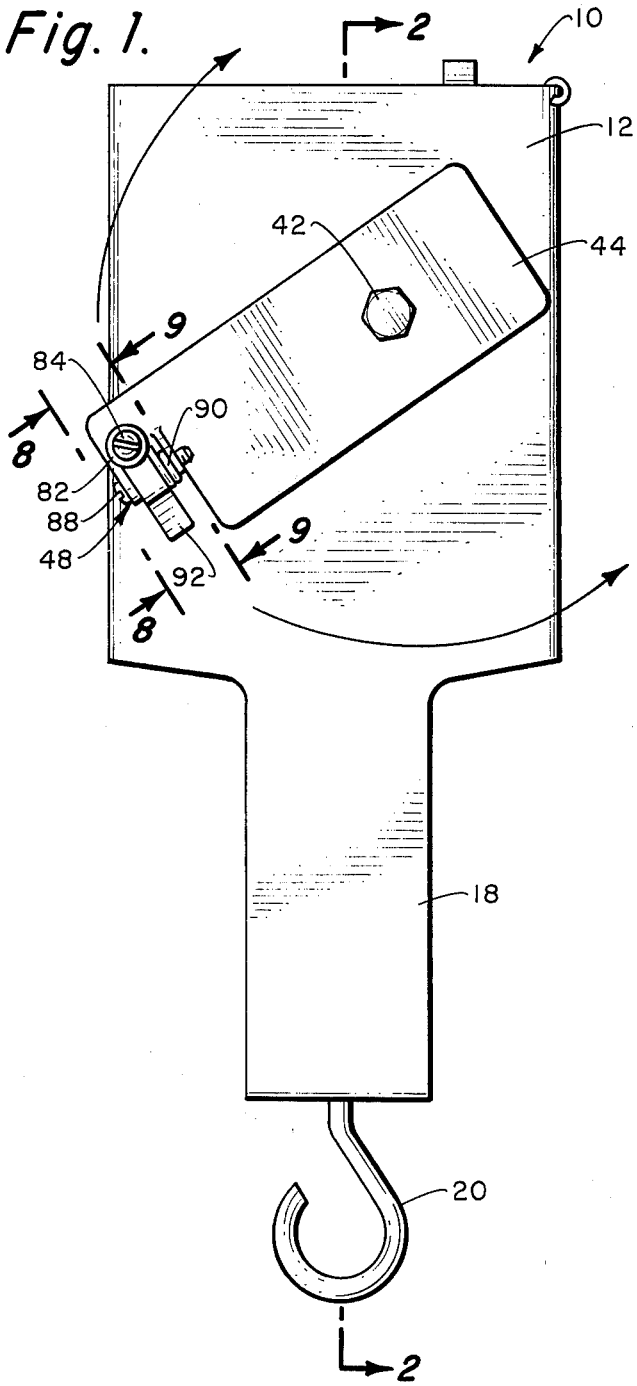
FIG. 1 is a plan view of the rope pulling device of this invention clearly showing the rotational movement of the handle with respect to the housing.
Figure 2:
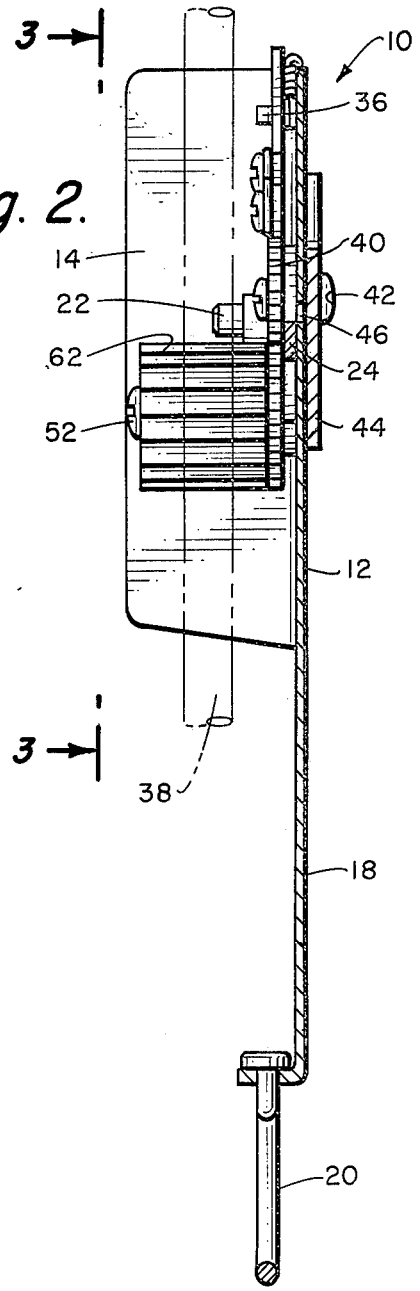
FIG. 2 is a cross-sectional view taken along line 2—2 of FIG. 1.

Referring particularly to the drawings, there is shown the device 10 of this invention which includes a basically flat planar housing 12 having a spaced apart upstanding parallel side walls 14 and 16. Physically integrally attached to the housing 12 is an extension 18 to which is connected a hook 20. The hook 20 is to facilitate affixing of the housing 12 to a fixed object (not shown).

Pivotally mounted by pivot pin 22 on the housing 12 is a first plate 24. Also pivotally mounted upon the housing 12 by means of a pivot pin 26 is a second plate 28. Both of the plates 24 and 28 are interconnected together through a cam means which is in the form of a recess 30 formed within the plate 28 and a protuberance 32 formed within the plate 24. Both the plates 24 and 28 are basically to be formed of a thin rigid material as a metal. A coil spring 34 is connected to upstanding side 14 and upstanding member 36 integrally formed upon the plate 24. The coil spring 34 functions to normally bias the members 24 and 28 to substantially the position shown in FIG. 3 of the drawings which is adapted to accommodate a minimum diameter rope 38 shown in phantom lines. It is to be understood that upon movement of the plate 24 the plate 28 will automatically move in a mirror image in respect thereto due to the interaction of the cam means which comprises the protuberance 32 which rides within the recess 30.

Rotationally mounted upon the plate 24 is a drive gear 40. The gear 40 is rotationally mounted by means of threaded fastener 42 which passes through aligned openings in the drive gear 40, the first plate 24, the housing 12 and is fixedly secured to a handle 44. It is to be understood that the drive gear 40 and the handle 44 are basically an integral unit due to the interconnection by the fastener 42. In order to accommodate the movement of the first plate 24, the fastener 42 moves within a slot 46 formed within the housing 12.

Attached to the handle 44 is a graspable section 48 which will be explained in detail further on in the specification.

The drive wheel 40 is operatively connected to a first driven gear 50 which is rotationally mounted by means of pivot pin 52 upon the plate 24. The drive wheel 40 is also in engagement with an idler gear 54 rotationally mounted by means of pivot pin 56 upon the second plate 28. The idler gear 54 is in engagement with a second driven gear 58. The second driven gear 58 is mounted for rotational movement upon the second plate 28 by means of a pivot pin 60.

Figure 3:
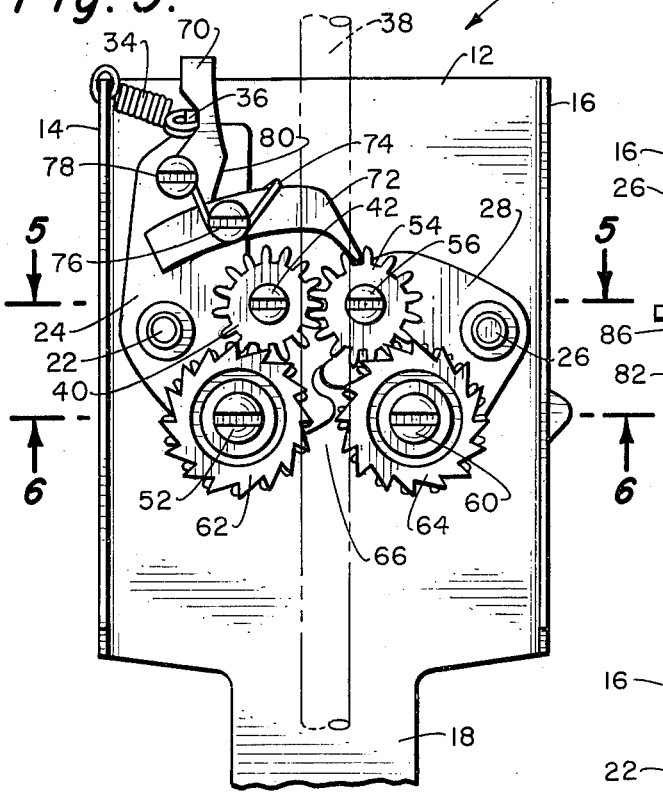
FIG. 3 is a segmental bottom view of the device of this invention taken along line 3—3 of FIG. 2 showing the device accommodating a small diametered rope.

Fixedly mounted upon the first driven gear 50 and adapted for simultaneous rotation therewith about pivot pin 52 is a first cog wheel 62. A second cog wheel 64 is fixedly mounted upon the gear 58 about the pivot pin 60. The cog wheels 62 and 64 interconnect together through a gap 66. It is within this gap 66 it is such that the rope, such as rope 38 within FIG. 3, is to be located and in physical contact with the wheels 62 and 64.

Figure 4:
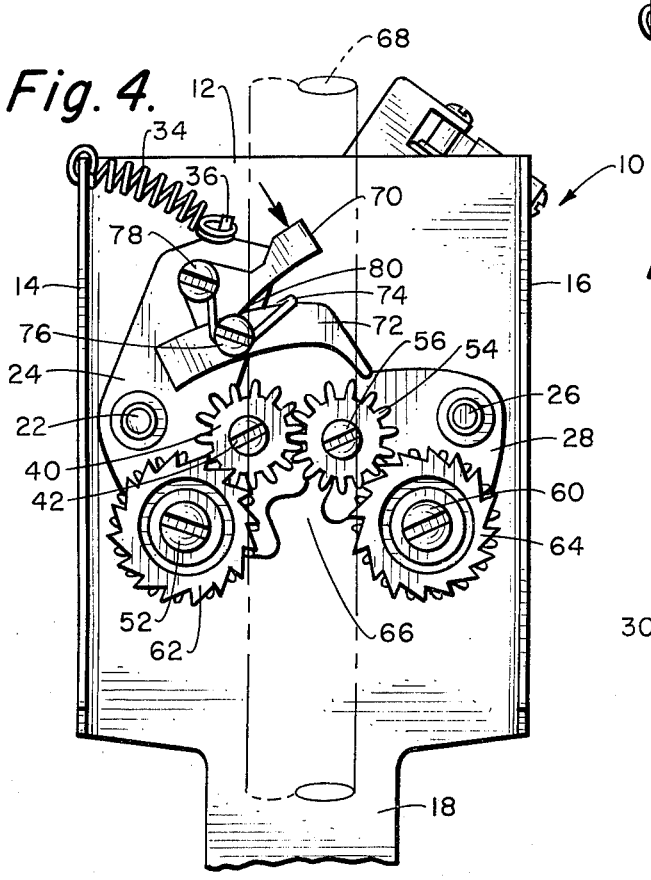
FIG. 4 is a view similar to FIG. 3, but showing the device accommodating a larger diametered rope.
Figure 7:
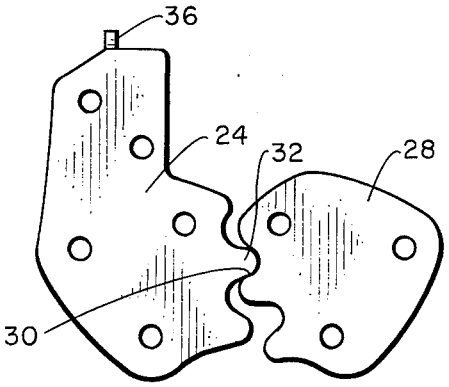
FIG. 7 is a view of the mounting plates upon which the gears and cog wheels are rotationally mounted and which, in turn, are pivotally mounted upon the housing clearly showing the interrelation between the plates.

Paying particular reference to FIG. 4 of the drawings, the cog wheels 62 and 64 may be spread apart to accommodate a larger diametered rope 68 such as shown in phantom within FIG. 4. It is to be noted that due to the biasing means 34 that the cog wheels 62 and 64 are continuously biased into engagement with whatever diametered rope is located within the gap 66.

In the operation of the device of this invention, it is to be understood by manually rotating of the handle 44 with respect to the housing 12, the drive gear 40 is rotated in a given direction which, in turn, causes the cog wheels 62 and 64 to be driven in opposite rotational directions but at the same rotational velocity. It is to be understood that the cog wheels 62 and 64 are the same physical size. The cog wheel 64 is driven in the opposite rotational direction due to the inclusion of the idler gear 54.

The device 10 of this invention is capable of accommodating between and eighth inch diameter rope to one inch diameter rope due to the expansion movement between the plates 24 and 28 separating the cog wheels 62 and 64.

Also incorporated within the device 10 of this invention is a ratchet assembly which takes the form of a first lever 70 and a second lever 72. The second lever 72 is biased into a continuous engagement by means of a spring 74 to idler gear 54. The second lever 72, when in engagement with idler gear 54, prevents reverse rotational movement of the idler gear 54 but permits forward rotational movement of the idler gear 54 by causing the lever 72 to move against the bias of the spring 74 out of engagement of the consecutive arranged teeth of the gear 54. Then the lever 72 is pivotally mounted upon the plate 24 by means of a pivot pin 76.

The first lever 70 is pivotally mounted by means of a pivot pin 78 upon the plate 24 and also functions as a connection for one end of the spring 74. The lever 70 is movable manually from the position shown in FIG. 3 to the position shown in FIG. 4 to physically disassociate the members 72 out of connection with the gear 54. This is desirable in certain instances to achieve freely rotational reversal movement. Otherwise, reverse rotational movement is not permitted. The upstanding member 36 also functions as a limiting stop for the member 70 in one direction of movement. In the other direction of movement the flattened surface 80 formed upon the member 70 is in abutting contact with the member 72 as shown in FIG. 4 of the drawings.

Figure 5:
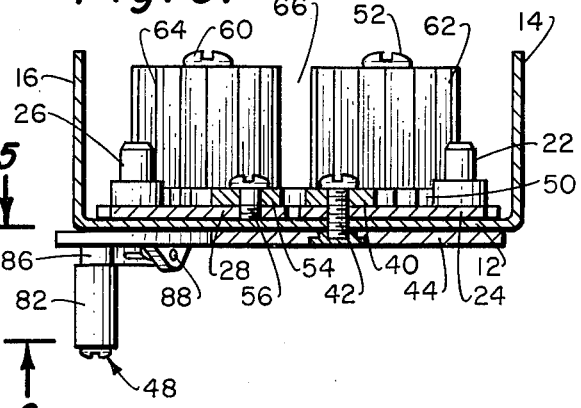
FIG. 5 is a cross-sectional view taken along line 5—5 of FIG. 3 showing in particular the operation between the drive gear and the idler gear.
Figure 6:
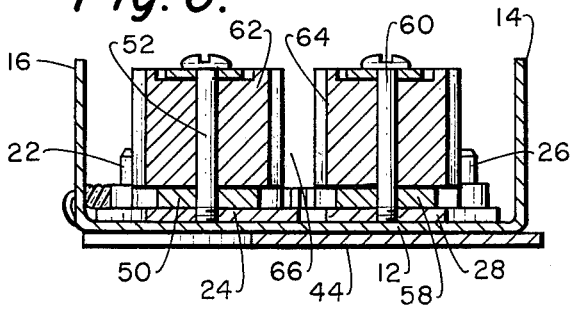
FIG. 6 is a cross-sectional view taken along 6—6 of FIG. 3 showing in detail the relationship between the rope contacting cog wheels.

Incorporated within the handle 44 is a safety lock assembly within the graspable section 48. The safety lock assembly comprises a member 82 which is rotationally mounted upon a pivot pin 84. The pivot pin 84 is secured to a member 86 which, in turn, is pivotally connected by means of a pin 88 to the handle member 44. A coil spring 90 is located between the handle 44 and the member 86. The coil spring 90 functions to continuously bias the member 86 to the position shown in phantom lines in FIG. 8 and also to the position shown in FIGS. 1, 5 and 9. In this position, the member 82, which includes lower extension 92, is capable of coming into physical contact withthe housing 12 or one of the side walls 14 and 16. When this occurs, further rotational movement of the handle 44 is prevented with respect to the housing 12.

Figure 8:
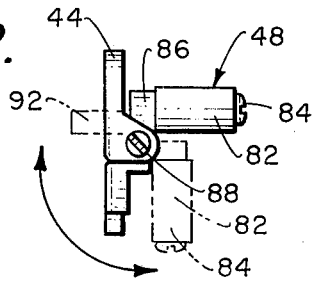
FIG. 8 is an end view of the handle assembly rotationally mounted upon the housing taken along line 8—8 of FIG. 1.
Figure 9:
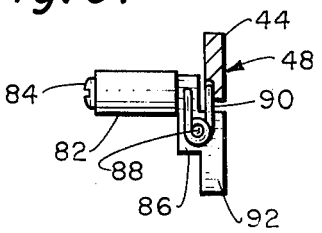
FIG. 9 is a cross-sectional view taken along line 9—9 of FIG. 1 showing in detail the safety lock assembly employed in conjunction with the handle means.

When the member 82 is physically grasped and pivoted with respect to handle 44 from the phantom line position shown in FIG. 8 to the solid line position shown in FIG. 8, rotational movement of the handle 44 is permitted. Therefore, upon accidental release of the member 82, the member 82 is automatically pivoted to the position shown in phantom lines in FIG. 8 with the result that the device functions as a limiting stop to prevent further rotational movement of the handle 44 with respect to the housing 12.

What is claimed is:

1. A rope pulling device comprising:

a housing including first means to facilitate attachment to an exterior object:

a first plate pivotally mounted upon said housing;

a second plate pivotally mounted upon said housing, cam means interconnecting said first and second plates;

a drive gear rotatably mounted on said housing, said drive gear being in continuous engagement with a first driven gear and through an idler gear to a second driven gear, said first driven gear being rotatably mounted on said first plate, said second driven gear being rotatably mounted upon said second plate, said first driven gear connected to a first cog wheel causing simultaneous rotation therewith, said second driven gear connected to a second cog wheel causing simultaneous rotation therewith, said first cog wheel being spaced from said second cog wheel and movable relative thereto by pivoting of said first and said second plates;

handle means rotatably mounted on said housing and fixed to cause rotation of said drive gear;

biasing means interconnecting said first plate and said housing, said biasing means exerting a continuous bias upon said first plate tending to maintain both said first and second plates in the position with said cog wheels having minimum spacing therebetween; and whereby upon manual rotation of said handle means said drive gear is rotated causing simultaneous reverse direction, identical velocity rotational movement of said first and second driven gears and therefore said first and second cog wheels, whereby a rope located between said first and second cog wheels is moved linearly in respect to said housing.

2. The device as defined in claim 1 wherein:

said cam means comprising a protuberance mounted on said first plate cooperating within a recess within said second plate.

3. The device as defined in claim 1 wherein:

the rotational axis of said first cog wheel being identical to the rotational axis of said first driven gear, the rotational axis of said second cog wheel being identical to the rotational axis of said second driven gear.

4. The device as defined in claim 1 including:

a spring biased detent movably mounted upon said handle means, said spring biased detent being continuously biased to a position to be capable of physically contacting said housing upon rotation of said handle means, upon manual rotation of said handle means said physical detent must be moved to a position not being capable of physically contacting said housing, whereby upon accidental release of said handle said detent will physically contact said housing after a limited amount of rotational movement of said handle thereby preventing further rotational movement of said handle.

5. The device as defined in claim 1 including:

ratchet means mounted upon said housing and in continuous contact with idler gear, said ratchet means functioning to prevent reverse rotational movement of said cog wheels.

6. The device as defined in claim 2 wherein:

the rotational axis of said first cog wheel being identical to the rotational axis of said first driven gear, the rotational axis of said second cog wheel being identical to the rotational axis of said second driven gear.

7. The device as defined in claim 6 including:

a spring biased detent movably mounted upon said handle means, said spring biased detent being continuously biased to a position to be capable of physically contacting said housing upon rotation of said handle means, upon manual rotation of said handle means said physical detent must be moved to a position not being capable of physically contacting said housing, whereby upon accidental release of said handle said detent will physically contact said housing after a limited amount of rotational movement of said handle thereby preventing further rotational movement of said handle.

8. The device as defined in claim 7 wherein:

ratchet means mounted upon said housing and in continuous contact with said idler gear, said ratchet means functioning to prevent reverse rotational movement of said cog wheels.

* * * * *